US012029339B2

(12) United States Patent
Abderrazak

(10) Patent No.: US 12,029,339 B2
(45) Date of Patent: Jul. 9, 2024

(54) SAFE PACKAGE

(71) Applicant: Hassan Abderrazak, Windermere, FL (US)

(72) Inventor: Hassan Abderrazak, Windermere, FL (US)

( * ) Notice: Subject to any disclaimer, the term of this patent is extended or adjusted under 35 U.S.C. 154(b) by 186 days.

(21) Appl. No.: 17/707,796

(22) Filed: Mar. 29, 2022

(65) Prior Publication Data

US 2022/0338659 A1 Oct. 27, 2022

Related U.S. Application Data

(63) Continuation-in-part of application No. 29/832,420, filed on Mar. 28, 2022.

(60) Provisional application No. 63/180,286, filed on Apr. 27, 2021.

(51) Int. Cl.
*A47G 29/20* (2006.01)
*A47G 29/124* (2006.01)
*A47G 29/22* (2006.01)

(52) U.S. Cl.
CPC ..... *A47G 29/20* (2013.01); *A47G 29/1251* (2017.08); *A47G 29/22* (2013.01)

(58) Field of Classification Search
CPC ..... A47G 29/20; A47G 29/141; A47G 29/22; A47G 29/1251; B65D 7/26; B65D 9/14; B65D 15/24; B65D 21/086
USPC ..... 232/38, 48
See application file for complete search history.

(56) References Cited

U.S. PATENT DOCUMENTS

| | | | | |
|---|---|---|---|---|
| 1,673,769 | A * | 6/1928 | Graham | G07C 13/02 220/6 |
| 10,696,453 | B2 * | 6/2020 | Sena | A47G 29/141 |
| 10,709,276 | B2 * | 7/2020 | Guanch | A47G 29/20 |
| 10,743,694 | B2 * | 8/2020 | Raphael | A47G 29/141 |
| 10,743,695 | B1 * | 8/2020 | Altmaier | B60R 9/065 |
| 10,786,103 | B2 * | 9/2020 | Teoh | B65D 11/1853 |
| 11,510,517 | B2 * | 11/2022 | McLean | B65D 11/1853 |
| 11,896,150 | B2 * | 2/2024 | Chiappetta | E05G 1/005 |
| 2017/0188737 | A1 | 7/2017 | Hippert | |
| 2018/0296016 | A1 * | 10/2018 | Teoh | A47G 29/20 |
| 2019/0225375 | A1 * | 7/2019 | Sena | A47G 29/20 |
| 2020/0260896 | A1 * | 8/2020 | Leng | A47G 29/1251 |
| 2021/0339905 | A1 * | 11/2021 | Darkwah | E05B 65/52 |
| 2021/0355741 | A1 * | 11/2021 | Chiappetta | A47G 29/141 |
| 2022/0008578 | A1 * | 1/2022 | Raphael | A47G 29/141 |
| 2022/0089317 | A1 * | 3/2022 | Aliahmad | A47G 29/20 |

(Continued)

OTHER PUBLICATIONS

Locking Column Box, Retrieved from Internet, Retrieved on Jan. 20, 2022 <URL: https://www.wayfair.com/Good-Ideas--Locking-Column-Box-PKGSAFTEK-L565-K~GEI10063.html>.

(Continued)

*Primary Examiner* — William L Miller

(57) ABSTRACT

The present invention provides a mailbox device comprising a first right side member, a second right side member, a first left side member, a second left side member, a front member, a back member, a first protective panel, a second protective panel, a top member and a bottom member. The bottom member can be configured to be folded up and locked to the front member and the top member can be configured to fold down. The first and second right sides can be configured to be folded inside. The first and second left sides can also be configured to be folded inside.

20 Claims, 7 Drawing Sheets

(56) References Cited

U.S. PATENT DOCUMENTS

| | | | | |
|---|---|---|---|---|
| 2022/0267048 | A1* | 8/2022 | Rogers | B65D 7/26 |
| 2022/0306337 | A1* | 9/2022 | Layton | B65D 11/186 |

OTHER PUBLICATIONS

Cosco Outdoor Living 88333BTN1E, Large Lockable Package Delivery and StoragBox, 6.3 Cubic feet, Tan BoxGuard, Retrieved from Internet, Retrieved on Jan. 20, 2022 <URL: https://www.amazon.com/Cosco-Outdoor-Living-88333BTN1E-Lockable/dp/B07XRS7TTB/>.

Secure Package Delivery, Retrieved from Internet, Retrieved on Jan. 20, 2022 <URL: https://www.wayfair.com/Keter--Secure-Package-Delivery-Box-245523-L565-K~KTR10032.html?>.

Payment Box—Fee Vaults/Mailbox, Retrieved from Internet, Retrieved on Jan. 20, 2022 <URL: https://www.outdoorsiness.com/Payment-Fee-Box?gclid=Cj0KCQiAraSPBhDuARIsAM3Js4ruG2p1E0M22LDrBjrikQEm9z1dm0jF8S34zf_ZQq7_13eC44jfnAkaAq1IEALw_wcB>.

* cited by examiner

SAFE PACKAGE

FIELD OF THE INVENTION

The present invention generally relates to a mailbox device. More specifically, the present invention relates to a mailbox device that incorporates a protective mechanism for outdoor use.

BACKGROUND OF THE INVENTION

A mailbox device with a protective mechanism for outdoor use is in demand. As online sales have become increasingly common, many consumers from around the world have become able to shop online.

Many online companies deliver purchased items to customers' doors by courier, but their transit time to the delivery point specified by the customer is often unknown, and even when the exact delivery date is known, not all customers can be available all day long to receive an item in person.

In such cases, when no one is available to sign for a package and receive it, a courier may leave the item at the door, with advance permission. However, such items are often vulnerable to theft.

Conventional mailboxes that can be used outdoors are designed to receive small items and do not include a protective mechanism that allows delivery personnel to put items inside the mailbox without a key while securing them in the mailbox. Thus, there is a need to develop a device to solve these problems.

The present invention is intended to address problems associated with and/or otherwise improve on conventional systems and devices through an innovative mailbox device that can be used outdoors and that is designed to provide a convenient and safe means of receiving items while incorporating other problem-solving features.

SUMMARY OF THE INVENTION

In accordance with the present invention, a mailbox device is provided that requires a first right side member, a second right side member, a first left side member, a second left side member, a front member, a back member. The present invention further includes a first protective panel and a second protective panel configured to protect items put inside the present invention. The present invention further includes a bottom member and a top member configured to move between an open position and a closed position.

In one embodiment, the first and second right sides can be panels with same dimension hinged together so that the first and second right sides can be folded inside, toward the inner space of the present invention.

In another embodiment, the first and second left sides can also be panels with same dimension hinged together so that the first and second left sides can be folded inside, toward the inner space of the present invention.

In some embodiments, the bottom member can include a first bottom member and a second bottom member that can be attached by a pivot and configured so that the first bottom member can be folded up and locked to the front member when the present invention is not being used.

In some embodiments, the top member can include a first top member and the second top member attached by a pivot so that the first top member can be configured to fold down. This folded state of the present invention may provide a compact structure that can be moved and stored conveniently.

DETAIL DESCRIPTIONS OF THE INVENTION

All illustrations of the drawings are for the purpose of describing selected versions of the present invention and are not intended to limit the scope of the present invention.

The present invention provides a mailbox device designed to be of benefit to online shoppers. The present invention can be used to receive small to midsized packages whose contents were ordered online. The present invention can be used outdoors so that delivery personnel can simply put packages inside it without fear of theft and without exposing them to potentially adverse weather conditions (e.g., heat, humidity, rain, wind).

The present invention can be attached to an outside wall when in use and can also be detached, folded down, and put away when users are not expecting a delivery.

Figure 1:
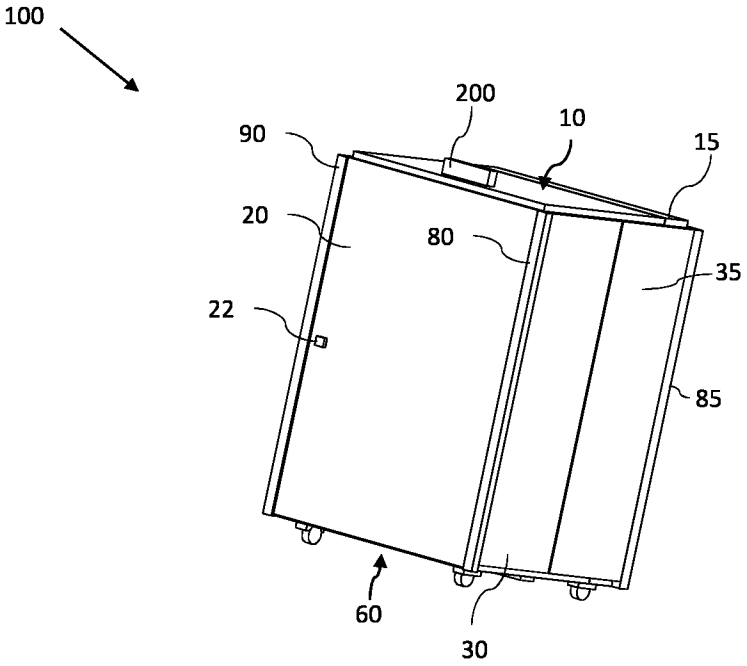
FIG. 1 is an illustration of one embodiment of the present invention.
Figure 2:
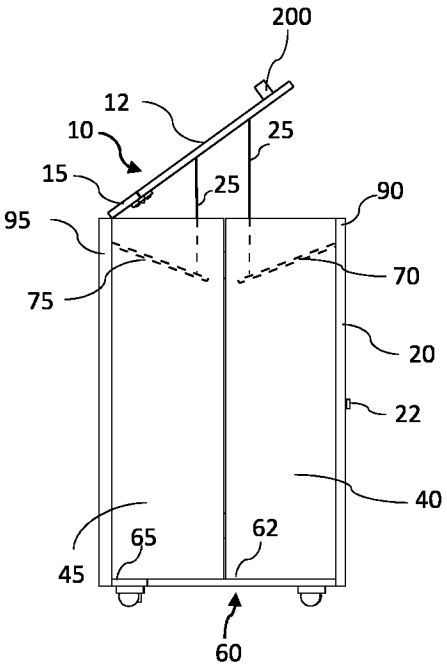
FIG. 2 is a side view showing one embodiment of the present invention with the top member in an opening state.
Figure 3:
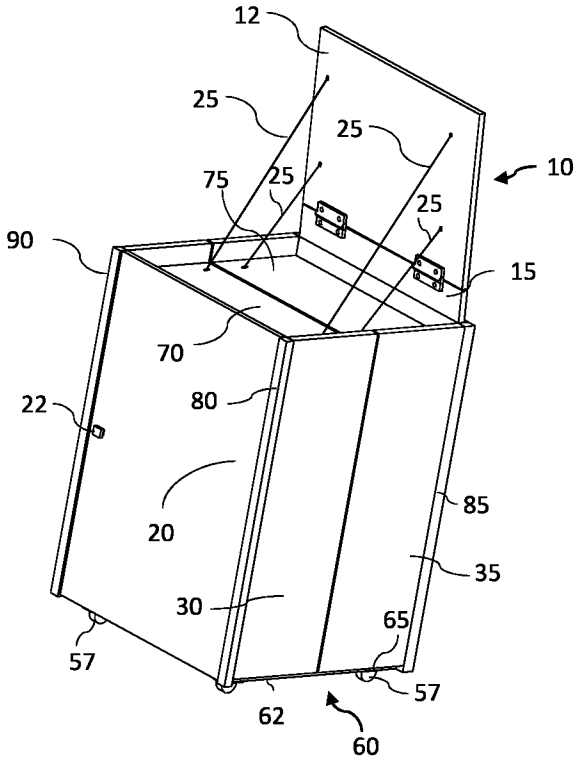
FIG. 3 is a side view showing one embodiment of the present invention with the top member fully opened.
Figure 4:
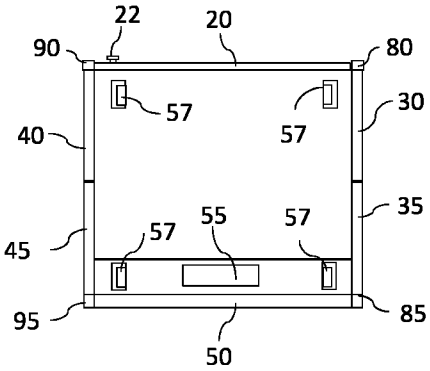
FIG. 4 is a bottom view of one embodiment of the present invention.

As FIGS. 1 to 7 show, the present invention provides a mailbox device 100 that comprises a top member 10, two side members including first and second right side members 30, 35 and first and second left side members 40, 45, a front member 20, a back member 50, and a bottom member 60 that define an inner space for containing mail pieces. The mailbox device 100 further includes two protective panels (first protective panel 70 and second protective panel 75) that cover the items put within it, as shown in FIGS. 2 and 3.

In some embodiments, the bottom member 60 can include a first bottom member 62 and a second top member 65.

In some embodiments, the top member 10 can include a first top member 12 and a second top member 15.

In some embodiments, the mailbox device 100 can include first and second right side posts 80, 85 and first and second left side posts 90, 95.

In such embodiments, first left side post 90 can be hinged to the first left side member 40. The front member 20 can be hinged to the first right side post 80, wherein the first right side post 80 is hinged to the first right side member 30. The back member 50 can be hinged to the second right side post 85, second left side post 95, the second top member 15, and the second bottom member 65, wherein the second right side post 85 is hinged to the second right side member 35 and the second left side post 95 is hinged to the second left side member 45.

The top member 10, side members (first and second right side members 30, 35 and first and second left side members 40, 45), front member 20, back member 50, and bottom member 60 can include one or more flat panels and be attached together using any fastener known in the art.

The present invention can be large enough to receive small to medium-sized packages and can be made of any material suitable for protecting them, whether metal, wood, plastic, or the like.

The inner space of the present invention can be fully opened and closed by the means of the top member 10, attached by a hinge to the top edge of the back member 50.

In some embodiments, the second top member 15 can be attached to the first top member 12 to form the top member 10 and the second top member 15 can be hingedly attached to the edge of the back member 50.

In some embodiments, the first top member 12 and the second top member 15 can be attached by a pivot so that the first top member can be configured to fold down, as shown in FIG. 2 and FIG. 3.

In some embodiments, the top member 10 can include a handle 200 positioned in any place suitable for helping open and close the top member 10.

The bottom member 60 can be mounted on the bottom edge of the back member 50 in such a way that the back member 50 can extend upward from the floor to stand perpendicular to the bottom member 60.

In some embodiments, the first bottom member 62 and the second bottom member 65 can be attached by a pivot. The first bottom member 62 can be configured to fold up and lock to the front member 20 using any locking means when the present invention is not being used.

In some embodiments, the bottom member 60 can include a support structure 55 (of any suitable shape and size) attached on the bottom surface of the bottom member 60, to provide stability.

In some embodiments, the bottom member 60 can include a plurality of wheels 57 attached on the bottom surface so that the present invention can be moved easily. The plurality of wheels 57 can also be attached to any other suitable places of the present invention including the back surface of the back member 50.

One of the edges of the front member 20 can be attached by a hinge to one of the first right side member 30 or the first left side 40 member, providing front access to the inner space by opening and closing the front member 20.

Figure 5:
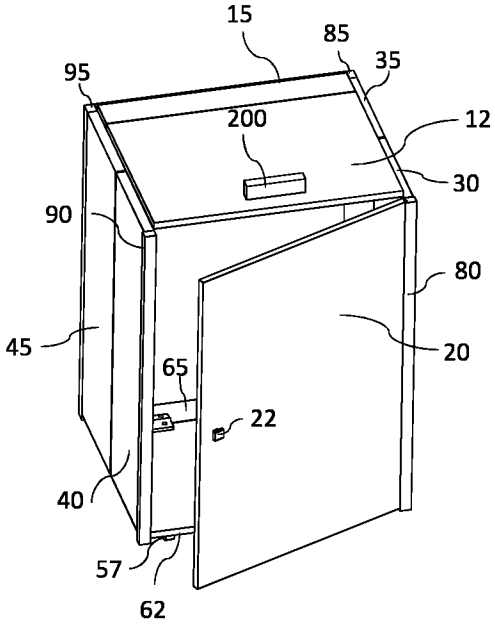
FIG. 5 an illustration of one embodiment of the present invention with the front member in an opening state.
Figure 6:
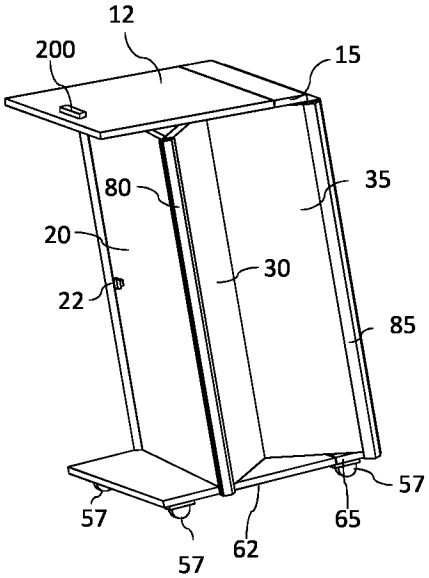
FIG. 6 an illustration of one embodiment of the present invention with the first and second right side members and first and second left side members in a folding state.

The front member 20 can include a locking mechanism known in the art so that the front member 20 can be locked for safety and opened by the user to take the delivered item out of the inner space, as shown in FIG. 5.

The first and second right side members 30, 35 can be flat panels hinged together to provide a foldable surface. The first and second left sides 40, 45 can also be flat panels hinged together to provide a foldable surface.

In the preferred embodiment, the first and second right side members 30, 35 can be panels with same dimension hinged together so that the first and second right side members 30, 35 can be folded inside, toward the inner space.

The first protective panel 70 and second protective panel 75 can be flat panels. The second protective panel 75 can be attached by a pivot to the top portion of the back member 50, and the first protective panel 70 can be attached by a pivot to the top portion of the front member 20, as shown in FIG. 3. The first protective panel 70 and second protective panel 75 can be further attached to a plurality of chains 25 (or any suitable straps) and connected to the top member 10 so that the first protective panel 70 and second protective panel 75 can move up and down when the user moves the top member 10 up and down.

In the preferred embodiment, the first protective panel 70 and second protective panel 75 are connected to the top member 10 by two chains 25 attached substantially near the corners (opposite the hinged areas) of the bottom surface of the top member 10 and the top surface of the first protective panel 70 and second protective panel 75, as shown in FIG. 3. In such an embodiment, the first protective panel 70 and second protective panel 75 can be moved up when delivery personnel open the top member 10, allowing a delivered package to be placed atop the first protective panel 70 and second protective panel 75 so that as soon as the top member 10 closes, the first protective panel 70 and second protective panel 75 underneath let the package drop. When the top member 10 is opened later, the first protective panel 70 and second protective panel 75 block the access to the inner space, preventing access to previously delivered packages.

The present invention thus secures such packages until the user (owner) of the box opens the front member (front door).

Figure 7:
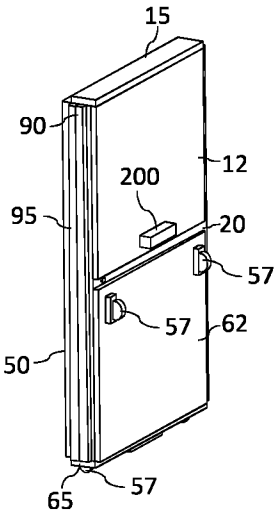
FIG. 7 an illustration of one embodiment of the present invention in a fully folded state.

When not in use, the first and second right side members 30, 35 and first and second left sides 40, 45 can be folded inside, allowing the top member 10 to be folded down and the bottom member 60 to be folded up and locked to the front member 20, as shown in FIG. 7. This folded state of the present invention may provide a compact structure that can be moved and stored conveniently.

In one aspect, the present invention may include a handle attached to the front member 20.

In some aspect, the present invention may include padding known in the art, which may include rubber, plastic, foam, synthetic material, or the like, to provide shock absorption with a view to protecting fragile contents of packages.

In another aspect, the present invention may include any type of insulation materials known in the art to keep the package cool inside the present invention.

In yet another aspect, the present invention may include a fastening mechanism configured to attach the present invention to an outside wall when expecting delivery of a package and detach it from the wall when no delivery is expected.

Although the invention has been explained in relation to its preferred embodiment, it is to be understood that many other possible modifications and variations can be made without departing from the spirit and scope of the invention.

What is claimed is:

1. A mailbox device comprising:

a first right side member;

a second right side member hinged to the first right side member, wherein the second right side member and the first right side member have a ratio of height to width of 2:0.5;

a first left side member;

a second left side member hinged to the first left side member, wherein the second left side member and the first left side member have a ratio of height to width of 2:0.5;

a first top member;

a second top member hingedly attached to the first top member, wherein the first top member is larger than the second top member;

a first bottom member;

a second bottom member hingedly attached to the first bottom member, wherein the first bottom member is larger than the second bottom member;

a first right side post;

a second right side post;

a first left side post hinged to the first left side member;

a second left side post;

a front member hinged to the first right side post, the first right side post is hinged to the first right side member;

a back member hinged to the second right side post, second left side post, the second top member, and the second bottom member, wherein the second right side post is hinged to the second right side member and the second left side post is hinged to the second left side member;

a first protective panel hingedly attached to the front member; and a second protective panel hingedly attached to the back member.

2. The mailbox device of claim 1, further comprising a locking mechanism attached to the front member.

3. The mailbox device of claim 1, further comprising padding attached to the second bottom member to provide shock absorption.

4. The mailbox device of claim 1, further comprising a plurality of wheels attached to the first bottom member and the back member.

5. The mailbox device of claim 1, further comprising a fastening mechanism attached to the back member and configured to attach the mailbox device to an outside wall.

6. A mailbox device comprising:

a first right side member;

a second right side member hinged to the first right side member, wherein the second right side member and the first right side member have a ratio of height to width of 2:0.5;

a first left side member;

a second left side member hinged to the first left side member, wherein the second left side member and the first left side member have a ratio of height to width of 2:0.5;

a front member hinged to the first right side member, wherein the front member includes a locking mechanism;

a first top member;

a second top member hingedly attached to the first top member, wherein the first top member is larger than the second top member;

a first bottom member;

a second bottom member hingedly attached to the first bottom member, wherein the first bottom member is larger than the second bottom member;

a back member hinged to the second right side member, the second left side member, the second top member, and the second bottom member;

a first protective panel hingedly attached to the front member; and a second protective panel hingedly attached to the back member.

7. The mailbox device of claim 6, further comprising padding attached to the second bottom member to provide shock absorption.

8. The mailbox device of claim 6, further comprising a plurality of wheels attached to the first bottom member and the back member.

9. The mailbox device of claim 6, further comprising a fastening mechanism attached to the back member and configured to attach the mailbox device to an outside wall.

10. A mailbox device comprising:

a first right side member;

a second right side member hinged to the first right side member, wherein the second right side member and the first right side member have a ratio of height to width of 2:0.5;

a first left side member;

a second left side member hinged to the first left side member, wherein the second left side member and the first left side member have a ratio of height to width of 2:0.5;

a front member hinged to the first right side member, wherein the front member includes a locking mechanism;

a first top member;

a second top member hingedly attached to the first top member, wherein the first top member is larger than the second top member;

a first bottom member having padding;

a second bottom member hingedly attached to the first bottom member, wherein the first bottom member is larger than the second bottom member;

a back member hinged to the second right side member, the second left side member, the second top member, and the second bottom member;

a first protective panel hingedly attached to the front member substantially near one edge of the front member, wherein the first protective panel is connected to the first top member by a plurality of chains; and a second protective panel hingedly attached to the back member substantially near one edge of the back member, wherein the second protective panel is connected to the first top member by a plurality of chains.

11. The mailbox device of claim 10, further comprising padding attached to the second bottom member to provide shock absorption.

12. The mailbox device of claim 10, further comprising a first right side post attached to the first right side member, a second right side post attached to the back member, a first left side post attached to the first left side member, and a second left side post attached to the back member.

13. The mailbox device of claim 10, further comprising a fastening mechanism attached to the back member and configured to attach the mailbox device to an outside wall.

14. The mailbox device of claim 10, wherein the second right side member and the first right side member include insulation material.

15. The mailbox device of claim 10, wherein the second left side member and the first left side member include insulation material.

16. The mailbox device of claim 10, wherein the second right side member, the first right side member, the second left side member and the first left side member include insulation material.

17. The mailbox device of claim 10, further comprising a locking mechanism attached to the first top member.

18. The mailbox device of claim 10, further comprising insulation material attached to the first top member.

19. The mailbox device of claim 10, further comprising insulation material attached to the first bottom member.

20. The mailbox device of claim 10, further comprising a plurality of wheels attached to the first bottom member.

* * * * *